US005722364A

United States Patent [19]

Watanabe et al.

[11] Patent Number: 5,722,364

[45] Date of Patent: Mar. 3, 1998

[54] THROTTLE LINKAGE MECHANISM

[75] Inventors: Takahide Watanabe; Yoshifumi Iwata, both of Hamamatsu, Japan

[73] Assignee: Sanshin Kogyo Kabushiki Kaisha, Shizuoka, Japan

[21] Appl. No.: 656,059

[22] Filed: May 31, 1996

[30] Foreign Application Priority Data

May 31, 1995 [JP] Japan ..... 7-133922

[51] Int. Cl.[6] ..... F02D 9/00

[52] U.S. Cl. ..... 123/336; 123/396; 123/423

[58] Field of Search ..... 123/328, 336, 123/376, 396, 400, 423, 583

[56] References Cited

U.S. PATENT DOCUMENTS 3,486,491 12/1969 White ..... 123/423 X
4,986,239 1/1991 Oishi ..... 123/423 X

FOREIGN PATENT DOCUMENTS 686962 5/1964 Canada ..... 123/396
2343753 3/1975 Germany ..... 123/396

*Primary Examiner*—Tony M. Argenbright
*Attorney, Agent, or Firm*—Knobbe, Martens, Olson & Bear, LLP

[57] ABSTRACT

An adjustable throttle damper retards closure of associated throttle valves. The throttle damper is positioned between runners of an intake manifold to which the throttle valves communicate. A lever selectively couples the throttle damper to a throttle linkage operating the throttle valves. This arrangement reduces the width of the engine. The throttle damper also operates against a lead throttle lever of the throttle linkage in order minimize the effect play in the linkage has on valve synchronization.

28 Claims, 8 Drawing Sheets

THROTTLE LINKAGE MECHANISM

BACKGROUND OF THE INVENTION

1. Field of the Invention

The present invention relates in general to an internal combustion engine, and more particularly to a throttle linkage mechanism.

2. Description of Related Art

Conventional engines which power outboard motors typically include a plurality of throttle valves to regulate the amount of air delivered to each cylinder of the engine. A throttle linkage commonly interconnects the throttle shafts of the throttle valves. The linkage generally synchronizes the operation of the throttle valves to stabilize engine rotation.

One or more throttle dampers often cooperate with the throttle devices to prevent the throttle devices from closing too rapidly. Rapid closure of the throttle devices can stall the engine or cause the engine to run too rich. The latter condition results in excessive hydrocarbon emissions. The throttle damper retards the rate at which the throttle devices close in order to inhibit these effects from occurring.

The previous way throttle dampers have cooperated with throttle devices, however, has lead to several drawbacks. For instance, some throttle devices have been supported and coupled with the throttle linkage at a location which protrudes from the side of the engine. This arrangement of the throttle damper within the engine has increased the size of the engine, and thus the size of the power head. The power head of an outboard motor generally extends above the transom of the watercraft and, consequently, a larger power head produces greater aerodynamic drag on the watercraft as the watercraft speeds over the water. The size and shape of the power head thus directly affects the amount of drag produced. The prior arrangement of the throttle damper within the engine has negatively increased the drag experienced by the outboard motor.

Prior throttle dampers also have not been adjustable. The particular engine speed at which the throttle damper begins to retard the closure of the throttle valves cannot be changed without affecting the effect of the throttle damper. If the throttle damper begins to retard the closure of the throttle valves at a significantly elevated engine speed, the speed of the engine at lower engine speeds cannot be immediately controlled. Engine responsiveness consequently suffers.

Throttle dampers additionally have tended to acerbate mis-synchronization between the throttle devices caused by play or slop within the throttle linkage. Throttle linkages often include an amount of play (i.e., looseness) within the linkage as a result of tolerances between the connections of the throttle linkage components. The throttle damper commonly acts against one of the throttle levers of the linkage when the linkage lies in a closed position. The throttle damper biases the lever toward the open position. As a result, the linkage rod must move to some degree to absorb (i.e., take-up) the play before the linkage rod can move the lever. As a result, the associated throttle valve opens late and is not in sync with the other throttle valves. Such variation between throttle valve positions destroys synchronization and causes the engine to run unevenly (i.e., roughly).

SUMMARY OF THE INVENTION

A need therefore exists for an improved throttle damper arrangement which does not acerbate the play within the throttle linkage while being adjustable relative to the throttle linkage. The position of the throttle damper also desirably reduces the width of the engine as compared with prior engine designs.

One aspect of the present invention involves an induction system for a marine engine. The induction system comprises a plurality of throttle devices which communicate with a plurality of runners of an engine intake manifold. A throttle linkage interconnects the throttle devices to synchronize the operation of the throttle devices which move at least through a range of travel between two operational positions. A throttle damper is positioned between two of the runners. The throttle damper is selectively coupled to the throttle linkage such that the throttle damper controls the movement of the throttle devices at least over a portion of the range of travel.

BRIEF DESCRIPTION OF THE DRAWINGS

These and other features of the invention will now be described with reference to the drawings of a preferred embodiment which is intended to illustrate and not to limit the invention, and in which.

DETAILED DESCRIPTION OF THE PREFERRED EMBODIMENT

Figure 1:
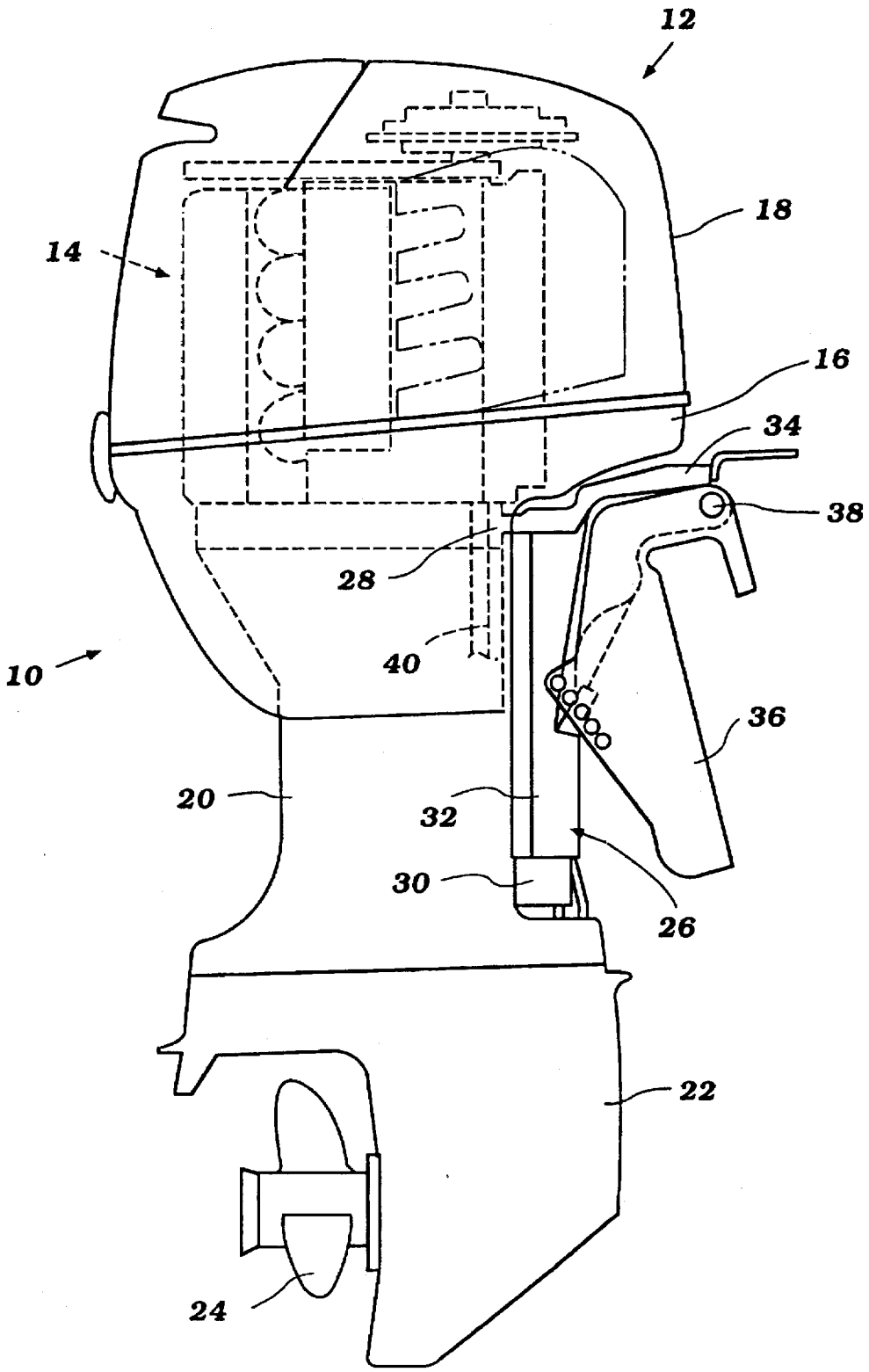
FIG. 1 is a side elevational view of an outboard motor having an engine incorporating a throttle linkage system configured in accordance with a preferred embodiment of the present invention.

FIG. 1 illustrates a conventional marine outboard drive 10 of the type in which the present throttle linkage mechanism can be incorporated. The present throttle linkage mechanism has particular utility with vertically oriented engines commonly employed in outboard motors. The inventive throttle linkage mechanism thus is described in connection with an outboard motor; however, the depiction of the invention in connection with an outboard motor is merely exemplary. Those skilled in the art will really appreciate that the present throttle linkage mechanism can be applied to an inboard motor of an inboard/outboard drive, to an inboard motor of a personal watercraft, and to other types of watercraft engines as well.

In the illustrated embodiment, the outboard drive 10 includes a power head 12, formed in part by an engine 14. The conventional cowling surrounds the engine 14. The cowling desirably includes a lower tray 16 and an upper cowling member 18. These components of the protective cowling 16, 18 together define an engine compartment which houses the engine 14.

A drive shaft housing 20 extends downwardly from the lower tray and terminates in a lower unit 22. The lower unit 22 can house a transmission (not shown) which selectively establishes a driving condition for a propulsion device 24, such as, for example, a propeller. The transmission desirably is a forward-neutral-reverse type transmission. In this manner, the propulsion device can drive the associated watercraft in any of these operating states.

A steering shaft assembly 26 is affixed to the drive shaft housing 20 at upper and lower brackets 28, 30. The brackets 28, 30 support a steering shaft for steering movement within a swivel bracket 32. Steering movement occurs about the generally vertical steering axis which extends through the steering shaft. A steering arm 34, which is connected to an upper arm of the steering shaft, can extend in a forward direction for manual steering of the outboard drive 10, as known in the art.

The swivel bracket 32 is also pivotably connected to a clamping bracket 36 by a pin 38. A clamping bracket 36, in turn, is configured to attach to the transom of the associated watercraft. This conventional coupling permits the outboard drive 10 to be pivoted relative to the pin 38 to permit adjustment of the trim position of the outboard drive 10 and for tilt-up of the outboard drive 10.

Although not illustrated, it is understood that a conventional hydraulic tilt and trim cylinder assembly, as well as a conventional hydraulic steering cylinder assembly can be used as well with the present outboard drive 10. The construction of the steering and trim mechanism is considered to be conventional and, for that reason, further description is not believed necessary for appreciation and understanding of the present invention.

The engine 14 is mounted conventionally with its output shaft or crankshaft 39 (FIG. 2) rotating about a generally vertical axis. The crankshaft drives a drive shaft 40 (FIG. 1) which depends from the power head 12 of the outboard motor 10 and extends through and is journaled within the drive shaft housing 20. The drive shaft 40 depends into the lower unit 22 to drive a drive gear of the transmission (not shown).

The engine 12 desirably is a four-stroke, in-line, four-cylinder combustion engine. It will be readily apparent to those skilled in the art, however, that the invention may be employed with engines having a different number of cylinders, having other cylinder orientations, and/or operating on other than a four-stroke principle, such as, for example, a two-stroke, crankcase compression principle. As best understood from FIG. 2, the engine 12 includes a cylinder block assembly 42 which in the illustrated embodiment defines four in-line cylinder bores (not shown). Pistons reciprocate within the cylinder bores and connecting rods link the pistons to the crankshaft 39 such that the reciprocal linear movement of the pistons within the cylinder bores rotates the crankshaft 39 in a known manner. A crankcase member 44 is attached to the cylinder block assembly 42 and surrounds at least a portion of the crankshaft 39. The crankshaft 39 is journaled within a crankcase chamber, which is formed by the crankcase member 44 and a skirt of the cylinder block assembly 42, and rotates about a generally vertical axis.

On the opposite side of the cylinder block assembly 42, a cylinder head assembly 46 is attached to close an end of the cylinder bores. The cylinder head assembly 46 generally has a conventional construction and supports a plurality of intake and exhaust valves and a valve operation mechanism (not shown). The cylinder head assembly 46 also at least partially journals at least one camshaft 48 which drives the valve operation mechanism in a known manner.

The valve operation mechanism can be any of a variety of conventional mechanisms. For instance, the overhead camshaft 48 can actuate rocker arms journaled about a rocker shaft to operate the valves within the cylinder head assembly 46. Alternatively, a plurality of overhead camshafts (e.g., intake and exhaust camshafts) can operate the valves directly using tappets, or can be located to the side of the cylinders to operate the valves via push rods, as known in the art. Because the present invention deals primarily with the construction of the throttle linkage system, it is believed unnecessary to provide further description of the particular valve operating mechanism beyond that provided above.

An intake manifold 49 forms a portion of the cylinder head assembly 46. The intake manifold 49 includes a plurality of runners 51. Each individual runner 51 communicates with an individual combustion chamber of the engine through the intake valve system (not shown).

A cam cover 50 together with the cylinder head assembly 46 define a cam chamber in which the valves, camshaft 48, and valve operation mechanism are located. The cam cover 50 is attached to a cylinder head assembly 46 on a side opposite that of the cylinder block assembly 42.

A timing belt 52 extends between a crankshaft pulley 54 and a pulley 56 coupled to the camshaft 48. As known in the art, the pulley 56 has a diameter twice that of the crankshaft pulley so that the crankshaft 39 drives the camshaft 48 at half the rotational speed of the crankshaft 39.

The engine 12 also includes an induction system 58. The induction system 58 includes an intake silencer 60 which is disposed to the front side of the power head 12 and on one side of the crankcase member 44. The intake silencer 60 draws air into the engine through at least one air inlet from the interior of the cowling and silences the intake air charge.

Figure 3:
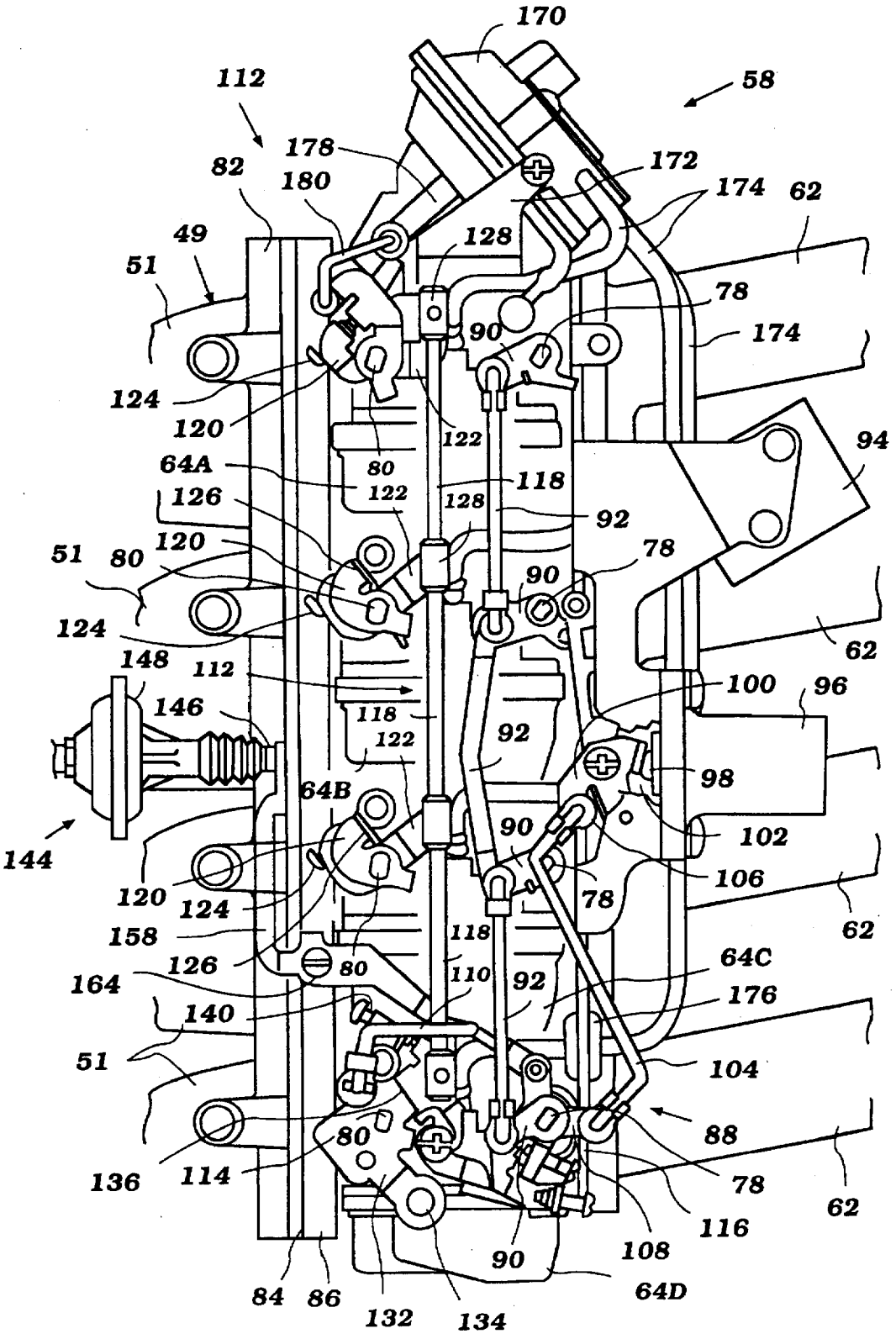
FIG. 3 is a partial side elevational view of an induction system of the engine of FIG. 2.
Figure 4:
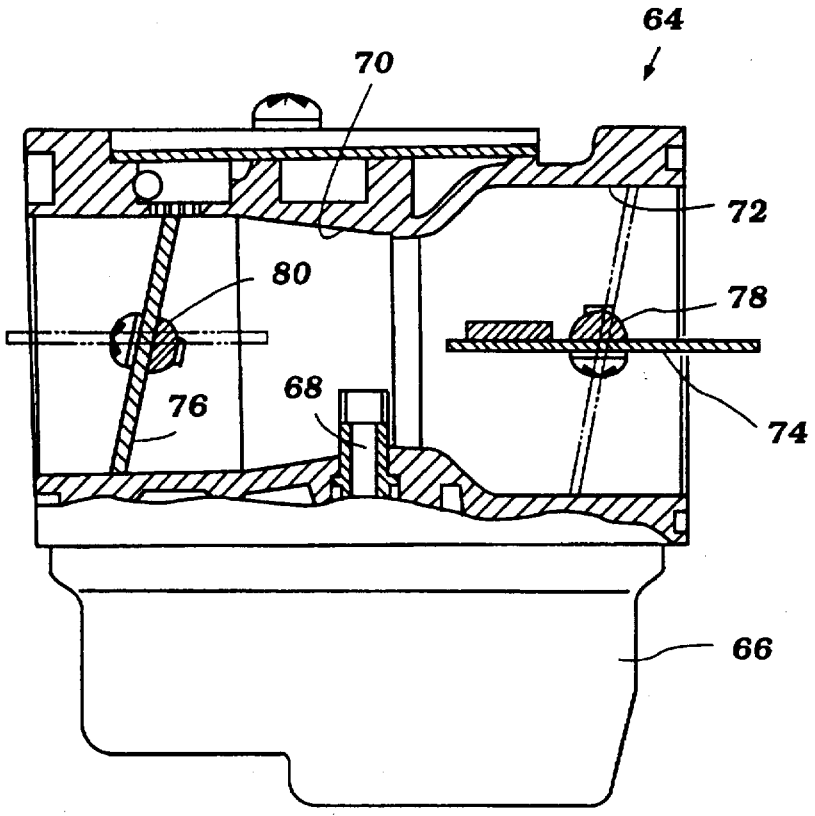
FIG. 4 is a partial sectional, side elevational view of a carburetor of the induction system of FIG. 3.

As seen in FIGS. 3 and 4, a series of induction pipes 62 deliver air from the intake silencer 60 to a plurality of charge formers 64. The lengths of the induction pipes 62 desirably are tuned with the intake silencer to minimize the noise produced by the induction system 58, as known in the art.

The charge formers 64 produce a charge of air and fuel which is delivered to the plurality of runners 51 of an intake manifold 49. In the illustrated embodiment, the charge formers 64 are a plurality of vertically aligned carburetors, each connected to one of the induction pipes 62. It should be understood, however, that although the invention is described in conjunction with a carbureted engine, certain facets of the invention may be employed in connection with other types of charge formers, such as fuel injectors or the like. For ease of description, each carburetor will be designated by an A, B, C, or D suffix, identified from the top down, and the collection of carburetors shall be designated generally by reference numeral 64 without suffix.

The carburetors 64 may be of any known type and construction. For instance, FIG. 4 illustrates one exemplary carburetor 64. The carburetor includes a fuel bowl 66 to which fuel is emitted through a float control valve (not shown) so as to maintain a uniform head of fuel therein. A main discharge tube 68 delivers fuel from the fuel bowl 66 to a Venturi restriction 70 in an air horn 72 of the carburetor body.

Each carburetor 64 also has a choke valve 74 and a throttle valve 76 to regulate the mixture of fuel and air to each cylinder of the engine 12, as known in the art. A choke shaft 78 supports the choke valve 74 within the air horn 72 of the carburetor 64 and controls the opening degree of the choke valve 74, as known in the art. In the illustrated embodiment, the choke valve 74 desirably is an offset butterfly-type valve, and rotation of the choke shaft 78 moves the choke valve 74 between a closed position and a wide-open position. The choke shaft 78 thus controls the angle of the choke valve 74 relative to the closed position (i.e., controls the choke angle). FIG. 4 illustrates the choke valve 74 in a wide-open position. Although the invention is described in connection with a butterfly-type valve, it is understood that the present invention can be used equally well with other types of choke valves, such as, for example, slider-type valves.

FIG. 4 also illustrates a throttle shaft 80 of the carburetor 64 which supports the throttle valve 76 within the air horn 72 of the carburetor 64. Like the choke valve 74, the throttle valve 76 desirably is a butterfly-type valve; however, it is understood that other types of valves, such as slider valves, can be used as well. Rotation of the throttle shaft 80 controls the orientation of the throttle valve 76 within the air horn 72, as known in the art.

As seen in FIG. 3, the carburetors 64 are attached between the induction pipes 64 and the runners 51 of the intake manifold 49. The carburetors 64 are attached to an intake manifold flange 82 by means that include a common insulator assembly 84, such that each carburetor 64 delivers a charge to the corresponding intake runners 51 of the intake manifold 49. A suitable insulator assembly disclosed in U.S. Pat. No. 5,556,385, issued Sep. 3, 1996, and assigned to the assignee hereof, which is hereby incorporated by reference.

The carburetors 64 are attached to the corresponding runners 51 by means that include a common mounting plate 86. The common mounting plate 86 is attached to the manifold flange 82 in a known manner. On the opposite side of the carburetors 64, i.e., the inlet side, the carburetors 64 are attached to the outlet of the induction pipes 62 in a known manner.

FIG. 3 illustrates an engine choke actuation system 88 configured in accordance with the description provided in U.S. Pat. No. 5,537,964, issued Jul. 23, 1996, and assigned to the assignee hereof, which is hereby incorporated by reference.

A choke linkage interconnects the choke shafts 78. The choke linkage includes a series of choke levers 90 interconnected by a plurality of linkage rods 92. The linkage rods 92 interconnect the ends of the choke levers 90 at a point distanced from the choke shafts 78 with conventional clips connecting the ends of the linkage rods 92 to the choke levers 90.

A choke solenoid 94 is coupled to the choke linkage to operate the choke shafts 78 in unison. In the illustrated embodiment, the solenoid 94 is attached to an L-shaped choke lever 92 coupled to the second choke shaft 78B; however, it is understood that the choke solenoid 94 and the corresponding L-shaped choke lever 90 can be positioned on any choke shaft 78 provided that the position also accounts for the spacing demands of the engine layout. The linkage rods 92 are attached to end of the other leg of the choke lever 90 with the choke shaft 78 being positioned at the intersection of the two legs. In this manner, the solenoid 94 rotates the choke shaft 78 in one direction to close the choke valve 74 by pulling on the end of the first leg of the choke lever 90. This movement rotates the choke lever 90 about the axis of the choke shaft 78 which forces the choke linkage to move. The choke linkage in turn rotates the other choke shafts 78 in the same direction and to the same degree.

Although not illustrated, a torsion spring is coupled to some or all of the choke levers 90 to bias the choke valves 74 toward an open position. That is, the spring biases the associated choke shaft 78 and the choke linkage in the direction opposite to that in which the solenoid 94 pulls the choke linkage and rotates the choke shafts 78.

FIG. 3 also illustrates a choke control mechanism which controls the opening degree of the choke valves 78 at all phases during engine warmup (i.e., during the engine start phase and during the engine warmup phase). The choke mechanism includes an actuator 96 with an extendable plunger 98. The extent to which the plunger 98 extends from the actuator desirably corresponds to the temperature of the engine 12, and more preferably corresponds to the temperature of an induction system 58 of the engine 12.

A variety of known actuator devices can be used for this purpose. For instance, in the illustrated embodiment, the actuator 96 is a conventional wax pellet used with a positive temperature coefficient (PTC) device.

The actuator 96 acts upon a movable cam 100 which rotates about a support shaft. The movable cam 100 includes a tang which is distanced from the axis of rotation of the cam 100 and forms an abutment surface upon which the actuator plunger 98 acts. Although not illustrated in FIG. 3, the movable cam 100 also defines a plurality of camming surfaces which cooperate with a guide slot of a support plate 102. The movable cam 100 is positioned above the fixed support plate 102. Rotation of the cam member 100 about the support shaft varies the overlap pattern between the guide slot of the fixed support plate 102 and the space defined between the camming surfaces of the movable cam 100.

A choke control rod 104 includes a follower 106 which is captured between the fixed support plate 102 and the movable cam 100 within the space defined by the overlap between the guide slot and the space between the cam surfaces of the movable cam 100. The follower 106 desirably is a roller which rotates over the edges of the first and second cam surfaces and/or over an edge surface of a guide slot defined by the fixed support plate 102. The follower 106 is attached to an end of the control rod 106. An opposite end of the control rod is attached to an end of the carrier lever 108.

The choke control mechanism 88 also acts upon the throttle shafts 80 of the carburetors 64 to open the throttle valves 76 to a greater degree than at an idle position during the phases of engine starting and warmup. For this purpose, a link 110 connects the carrier lever 108 to a portion of a throttle linkage 112. In the illustrated embodiment, the link 110 connects to a throttle lever 114 attached to the throttle shaft 80 of the fourth carburetor 64D.

The choke solenoid 94, actuator 96, cam 100 and support plate 102 desirably are mounted to the engine proximate to the carburetors, and more preferably attached to a support bracket 116 which also interconnects the carburetors 64. A suitable mounting arrangement and assembly is disclosed in U.S. Pat. No. 5,524,596, issued Jun. 11, 1996, and assigned to the assignee hereof, which is hereby incorporated by reference.

The operation of the choke control and cold start mechanism 88, including its actuation of the throttle linkage 112, is described in U.S. Pat. No. 5,537,964, which has been incorporated by reference. Because the present invention deals primarily with the construction of the throttle linkage system, it is believed unnecessary to provide a further description of the choke control and cold start mechanism 88 beyond that provided above.

Figure 5:
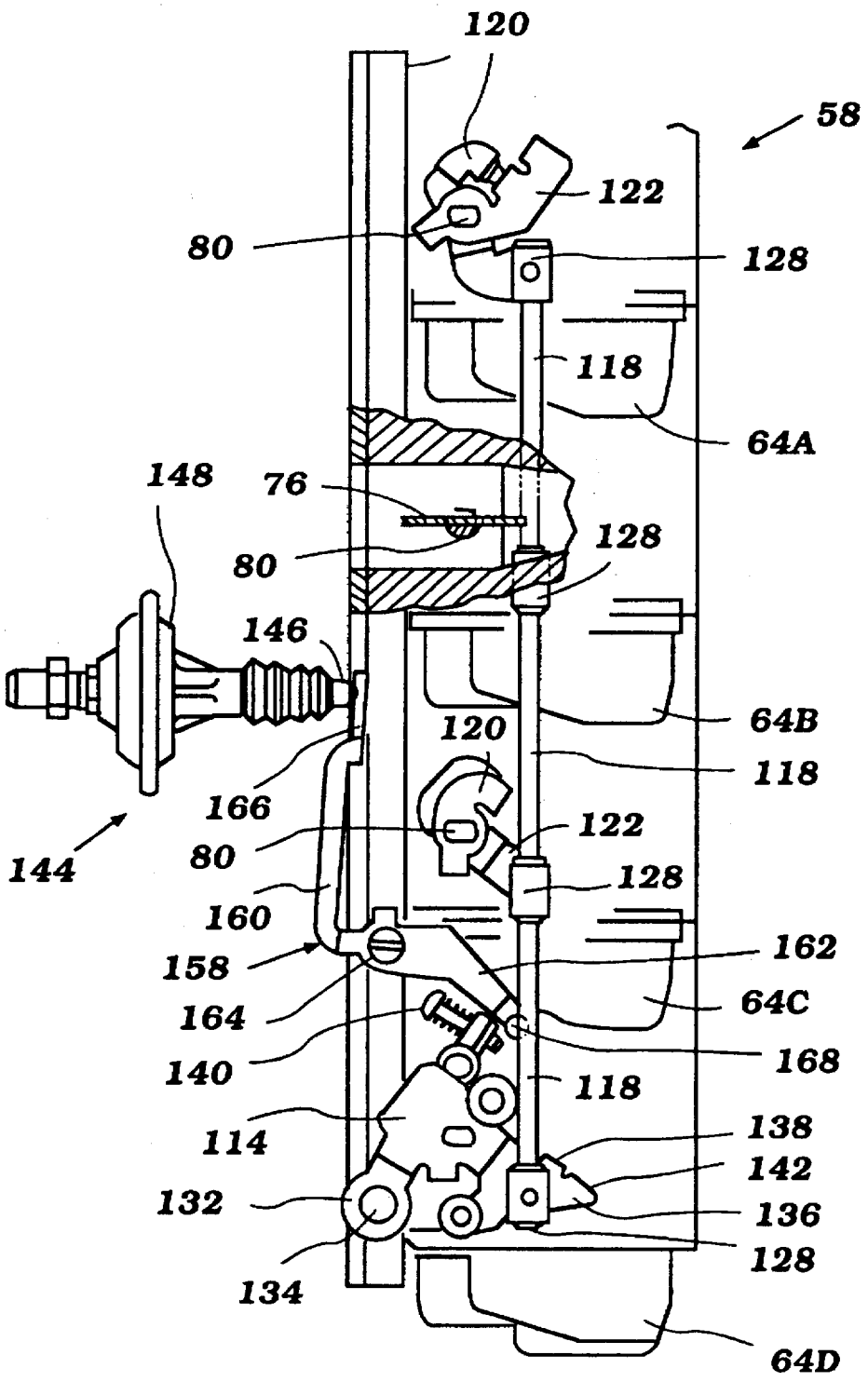
FIG. 5 is a partial sectional, side elevational view of the linkage mechanism and the associated carburetors of the induction system of FIG. 3 with the throttle valves positioned in a wide-open state.

With reference to FIG. 5, the throttle linkage 112 is formed in part by a plurality of throttle levers interconnected by a series of throttle rods 118. Though the following describes the throttle linkage 112 in reference to its illustrated vertical orientation, it is understood that the present invention also is applicable with other arrangements of the charge formers 64.

In the illustrated embodiment, throttle levers attached to the throttle shafts 80 of the three upper carburetors 64A, 64B, 64C are substantially identical, and the following description of one is understood as applying to all, unless specified to the contrary.

As seen in FIGS. 3 and 5, a first throttle lever is attached to the throttle shaft 80 of the upper carburetor 64A. First and second segments 120, 122 of the throttle lever are fixed onto the throttle shaft 80 by inserting the throttle shaft 80 through apertures in the lever segments 120, 122. The first segment 120 extends away from the throttle shaft end 80 and cooperates with an adjustment screw 124. A torsion spring 126 biases the first segment 120 toward the closed position. The adjustment screw 124 limits the rotation of the throttle lever segment 120 in this direction and is used to synchronize the position of the throttle valves 76 when in the closed position.

Figure 9:
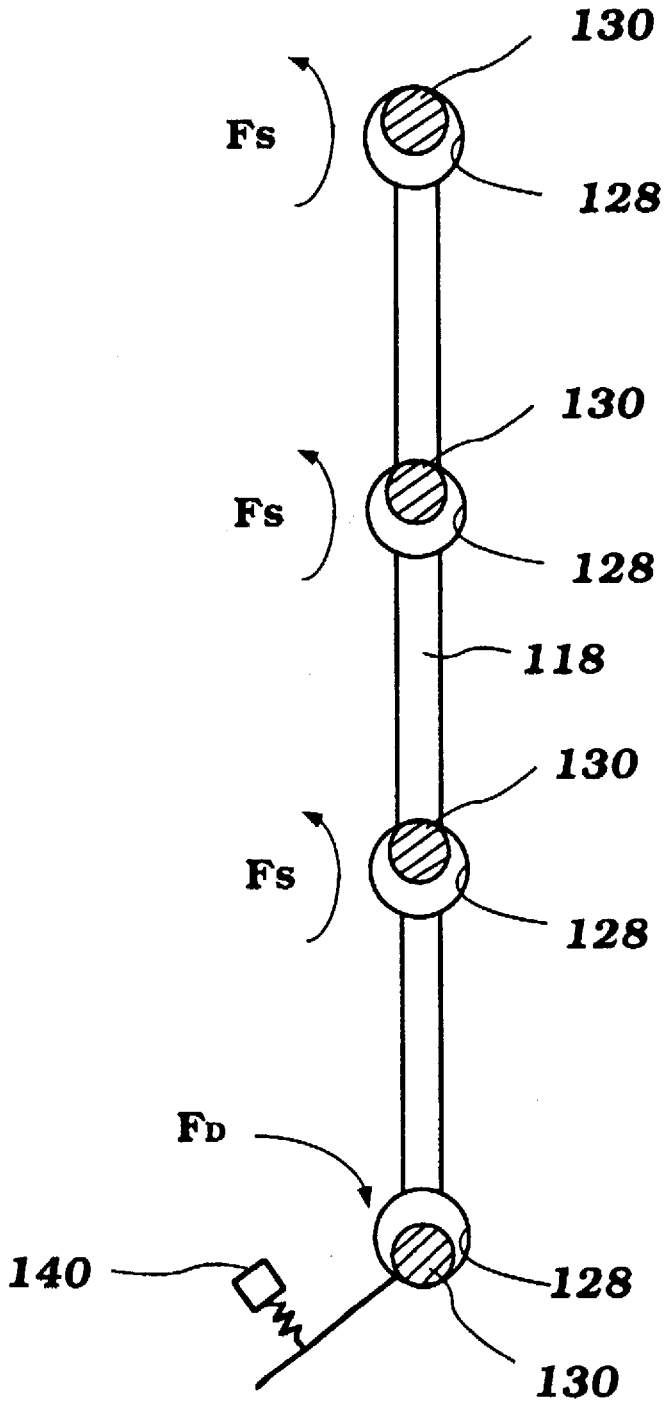
FIG. 9 is a schematic force diagram of the forces acting on the linkage system with the throttle valves in the closed position.

A clip 128 connects an end of the second throttle lever segment 122 to one of the throttle rods 118. In the illustrated embodiment, the clip 128 cooperates with a snap connector 130 formed on the end of the lever segment 122. FIG. 9 schematically illustrates the snap and clip interconnection, while exaggerating the tolerance between these parts. The clip 128 snaps over the snap connector 130 to connect at least one of the linkage rods 118 to the lever segment 122 and to allow the linkage rod 118 and lever segment 122 to rotate relative to each other as the linkage 112 opens and closes the throttle valves 76.

The clip 128 of the middle levers also interconnects adjacent ends of the linkage rods 118. In the illustrated embodiment, the linkage rods 118 lie in series and extend in a generally vertical direction between the throttle levers of the upper carburetor 64A and the lower carburetor 64D.

In the illustrated embodiment, the throttle lever 114 of the lower carburetor 64D acts as a lead throttle lever and operates the throttle linkage 112 as described below. The lead throttle lever 114 generally has an L-shape with an aperture receiving the throttle shaft 80. The lever 114 is fixed to the end of the associated throttle shaft 80.

One leg 132 of the lead throttle lever 114 includes a coupling 134 to which a throttle operator mechanism is coupled, as described below. The throttle shaft 80 thus rotates with the lead throttle lever 114 about the axis of the throttle shaft 80.

As best seen in FIG. 5, the other leg 136 of the lead throttle lever 114 includes an abutment surface 138 for contact with a throttle adjustment screw 140 that defines the idle position of the throttle valve 76, as known in the art. The link 110 between the choke control mechanism 88 and the lead throttle lever 114 also connects to the this leg 136 of the lever 114. The link 110 establishes a fast idle position of the throttle valves 76, as described in U.S. Pat. No. 5,537,964, incorporated by reference above.

The second leg 136 of the lever 114 also defines a tang 142 toward an outer end of the leg 136. The tang 142 is positioned to lie further away from the throttle shaft 80 (i.e., the rotational axis of the lever 114) than the abutment surface 138 which engages the adjustment screw 140.

A clip 128 connects the lowermost linkage rod 118 to the outer end of the second leg 136 of the lead throttle lever 114. The clip 128 interconnects with a snap connector 130 in the manner described above. Rotation of the second leg 136 of the lead throttle lever 114 about the axis of the associated throttle shaft 80 moves the throttle linkage 112 up or down. In the illustrated embodiment, clockwise rotation moves the throttle linkage 112 down to open the throttle valves 76, and counter-clockwise rotate moves the throttle linkage 112 up to close the throttle valves 76. In this manner, the throttle linkage 112 synchronizes the operation of the throttle shafts 80.

Figure 6:
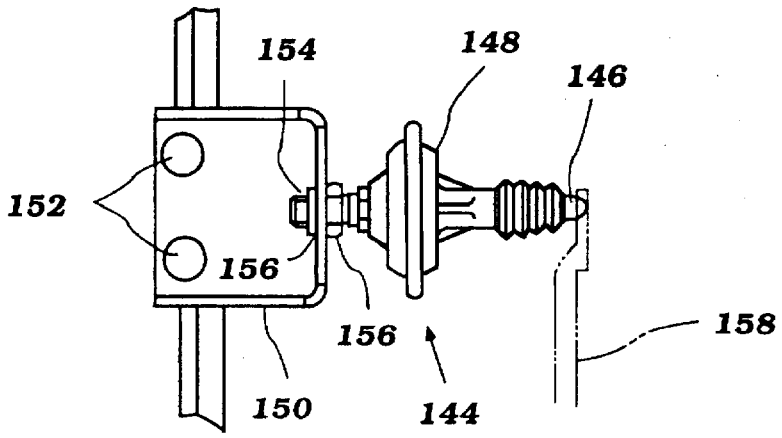
FIG. 6 is a side elevational view of a damper of the linkage system of FIG. 5.

A throttle damper 144 operates with the throttle linkage 112 to slow closure of the throttle valves 76 once the position of the throttle valves 76 near the closed position. In the illustrated embodiment, as best seen in FIG. 6, the throttle damper 144 comprises a dash-pot with a plunger 146 that operates relative to a body 148 of the throttle damper 144. The plunger 146 slowly retracts into the body 146 along an actuation axis once a force is applied against it.

Figure 2:
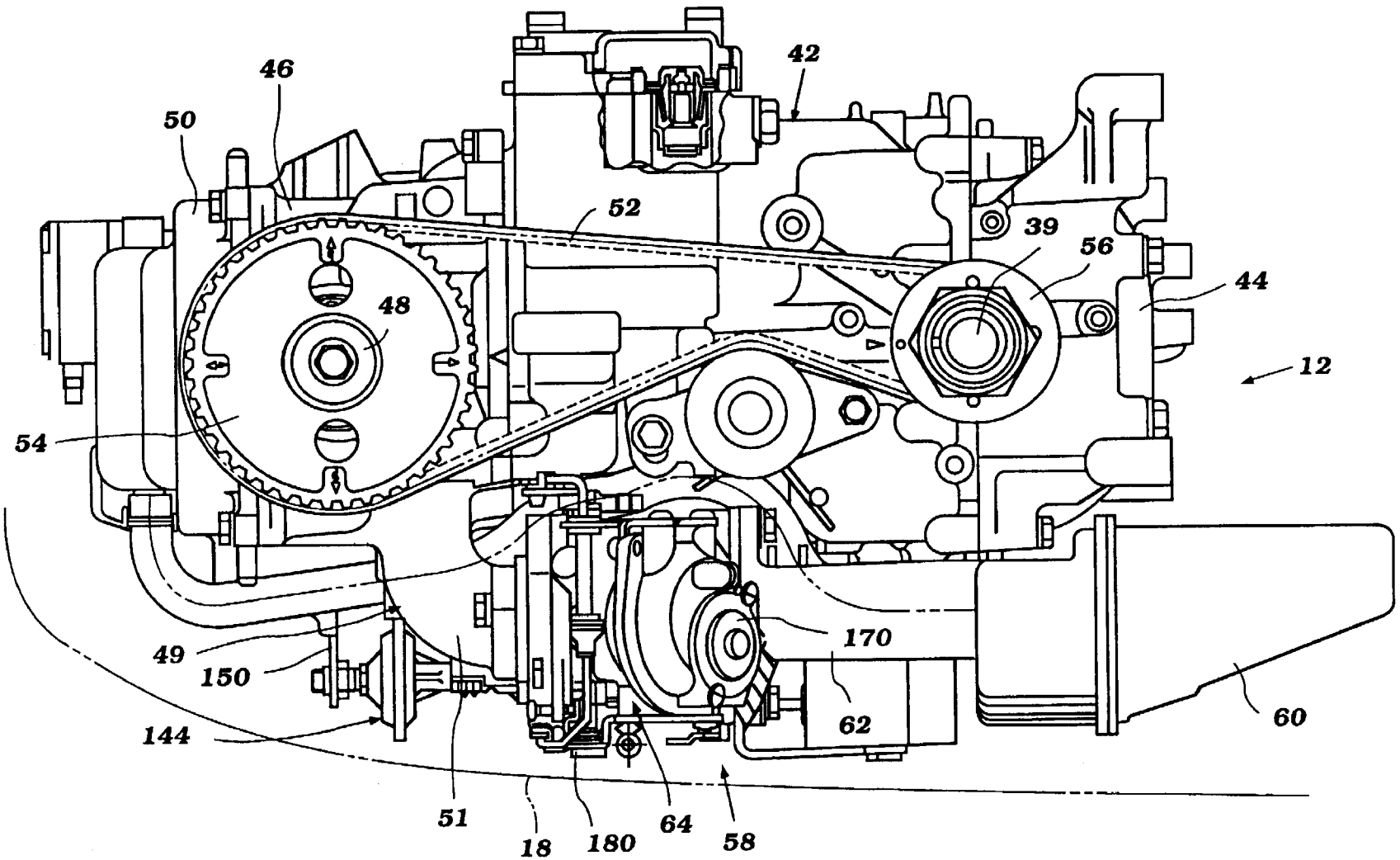
FIG. 2 is an enlarged, partial top plan view of the engine of the outboard motor of FIG. 1.

As best seen in FIGS. 2 and 3, the throttle damper 144 lies between a pair of runners 51 of the intake manifold 49 in order to reduce the width of the engine 12. In the illustrated embodiment, the throttle damper 144 lies between the second and third runners 51, as counted down from the top.

A bracket 150 supports the throttle damper 144 in this position. As understood from FIGS. 2 and 6, bolts 152 secure the bracket 150 to the intake manifold 49. The bracket 150 includes a mounting aperture which receives a portion of the throttle damper 144. In the illustrated embodiment, the throttle damper 144 includes a threaded stud 154 positioned at its rear end. Nuts 156 are threaded onto the threaded stud 154 and are tightened on either side of the bracket 150. The position of the throttle damper 144 relative to the bracket 150 thus can be adjusted by moving the nuts 156 along the length of the stud 154. This of course changes the position of the throttle damper 144 relative to the throttle linkage 112.

With reference to FIGS. 3 and 5, a coupling selectively couples the throttle damper 144 to the linkage system. The coupling couples the throttle damper 144 to the linkage when the throttle valves 76 near their close position. When the throttle valves 76 open, however, the throttle damper 144 is decoupled from the throttle linkage 112.

In the illustrated embodiment, the coupling comprises a lever 158 which operates between the throttle linkage 112 and the throttle damper 144. The lever 158 generally has an L-shape, formed between two legs 160, 162. A support shaft 164 (e.g., a screw) supports the lever 158 at a point where the two legs 160, 162 intersect and in a manner permitting the lever 158 to rotate relative to the support shaft 164. The support shaft 164 desirably lies between the third and fourth runners 49 (counting down from the top) and is coupled to the common support plate 86 of the carburetors 64.

As best seen in FIG. 5, one leg 160 of the lever 158 includes a flat abutment surface 166 which is positioned to contact the plunger 146 of the when the lever arm 160 is rotated toward the throttle damper 144. The abutment surface 166 desirably lies generally perpendicular to the actuation axis of the plunger 146 when it come into contact with the plunger 146.

The other leg 162 of the lever 158 includes a follower 168 which cooperates with the tang 142 on the lead throttle lever 114, as described below. As seen in FIG. 5, the follower 168 desirably lies on an outer end of the leg 162 and near the adjustment screw 140 for the lead throttle lever 114. The tang 142 of the lead throttle lever 114 contacts the follower 168 and rotates the lever 158 when the throttle valves 76 are closing and nearing the closed position. In this manner, the throttle damper 144 is arranged to cooperate with the throttle linkage 112 and slow the closure of the throttle valves 76 just before the valves 76 move to the closed position.

With reference to FIG. 3, the throttle linkage 112 also operates an accelerator pump 170. A bracket 172 supports a diaphragm-type accelerator pump 170 near the upper carburetor 64A. The accelerator pump 170 communicates with each carburetor 64 to supply an incremental, additional amount of fuel to the air flow through the air horn 72 of the carburetors 64 during rapid or full throttle acceleration of the engine 12.

The external accelerator pump 170 may be of any known type. For instance, the accelerator pump 170 can be of the type described in Japanese patent publication No. 3-21551, which is hereby incorporated by reference. Such an accelerator pump 170 produces a pressurized pulse of air that is directed by the conduits 174 into the main fuel well 66 of the carburetor 64 to inject an additional amount of fuel from the main nozzle 68 into the Venturi section 70 of the carburetor 64.

The accelerator pump 170 also can be of the type which injects fuel directly into the air horns 72 of the carburetors 64 during rapid or full throttle acceleration of the engine 12. In this embodiment, the accelerator pump 170 is connected to the fuel supply system (not shown) of the engine 12 which provides fuel to the pump 170 for its discharging upon opening of the throttle valves 76 of the carburetor 64. A plurality of fuel lines 74 allow the accelerator pump 170 to provide fuel directly to the individual carburetors 64 at any desired location in the associated air horn, for example, proximate to the Venturi section 70. This fuel may be drawn from the fuel bowl 66 of one or more of the carburetors 64.

In either embodiment of the pump 170, the conduits or fuel lines 74 connect the acceleration pump 170 to each carburetor 64. The lines 74 are routed around the choke and throttle linkage mechanisms 88, 112 and are supported in a desired position by known means. For instance, a grommet 176, which is positioned in the support bracket 116, holds a portion of the conduit 74 leading to the lower carburetor 64D.

The accelerator pump 170 is operated by an actuator 178 that extends from the accelerator pump 170 and is connected by a link 180 to the throttle linkage 112. As best seen in FIG. 2, the link 180 comprises a U-shape member that is attached to a lever of the throttle linkage 112. The interconnection between the actuator 178, link 180, and throttle linkage 112 allows operation of the accelerator pump 170 to be controlled by the throttle valve position of the engine 12.

Operation of the throttle linkage 112 in a manner opening the throttle valves 76 causes the link 180 to move downwardly, in the illustrated embodiment, thereby moving the actuator 178 in a like direction. The downward movement of the actuator 178 operates the accelerator pump 170, which in turn increases the amount of fuel directed into the throttle passages 72 of the carburetors 64 during rapid or full throttle acceleration of the engine 12.

Although not illustrated, a throttle operator, such as a bowden-wire cable can connect to the lead throttle lever 114 in order to operate the throttle linkage 112. The cable couples the throttle linkage 112 to a conventional throttle control mechanism in a known manner. Actuation of the control mechanism operates the throttle linkage 112 to control the throttle valves 76 of the carburetors 64.

In the illustrated embodiment, actuation of the control mechanism extends the bowden wire cable to rotate the lead throttle lever 114 in the clockwise direction. Clockwise rotation of the lever 114 and thus the associated throttle shaft 80 opens the throttle valve 76.

The throttle linkage 112 communicates the rotation of the lead throttle lever 114 to the other throttle shafts 80. Specifically, the clockwise rotation of the lead throttle lever 114 moves the linkage rods 118 downward, causing the other throttle levers to rotate clockwise by the same degree. In this manner, the throttle linkage 112 communicates the rotation of the fourth throttle shaft 80 to the balance of the throttle shaft 80 so as to move the throttle valves 76 in the same direction and to the same degree.

FIG. 5 illustrates the position of the throttle linkage 112 when the throttle valves 76 are wide open. The tang 142 of the lead throttle lever 114 has rotated well away from the follower 168 of the lever 158 which operates between the throttle linkage 112 and the throttle damper 144. In this position, the lead throttle lever 114 is decoupled from the throttle damper 144. The follower 168 of the lever 158, however, remains close to the adjustment screw 140 of the lead throttle lever 114.

Retraction of the bowden wire cable moves the throttle linkage 112 in a similar manner, but in the opposite direction. The throttle levers 114 rotate in the counter-clockwise direction. The torsion springs 126 connected to the throttle levers 120 principally drive the throttle levers 120 in this manner.

Figure 7:
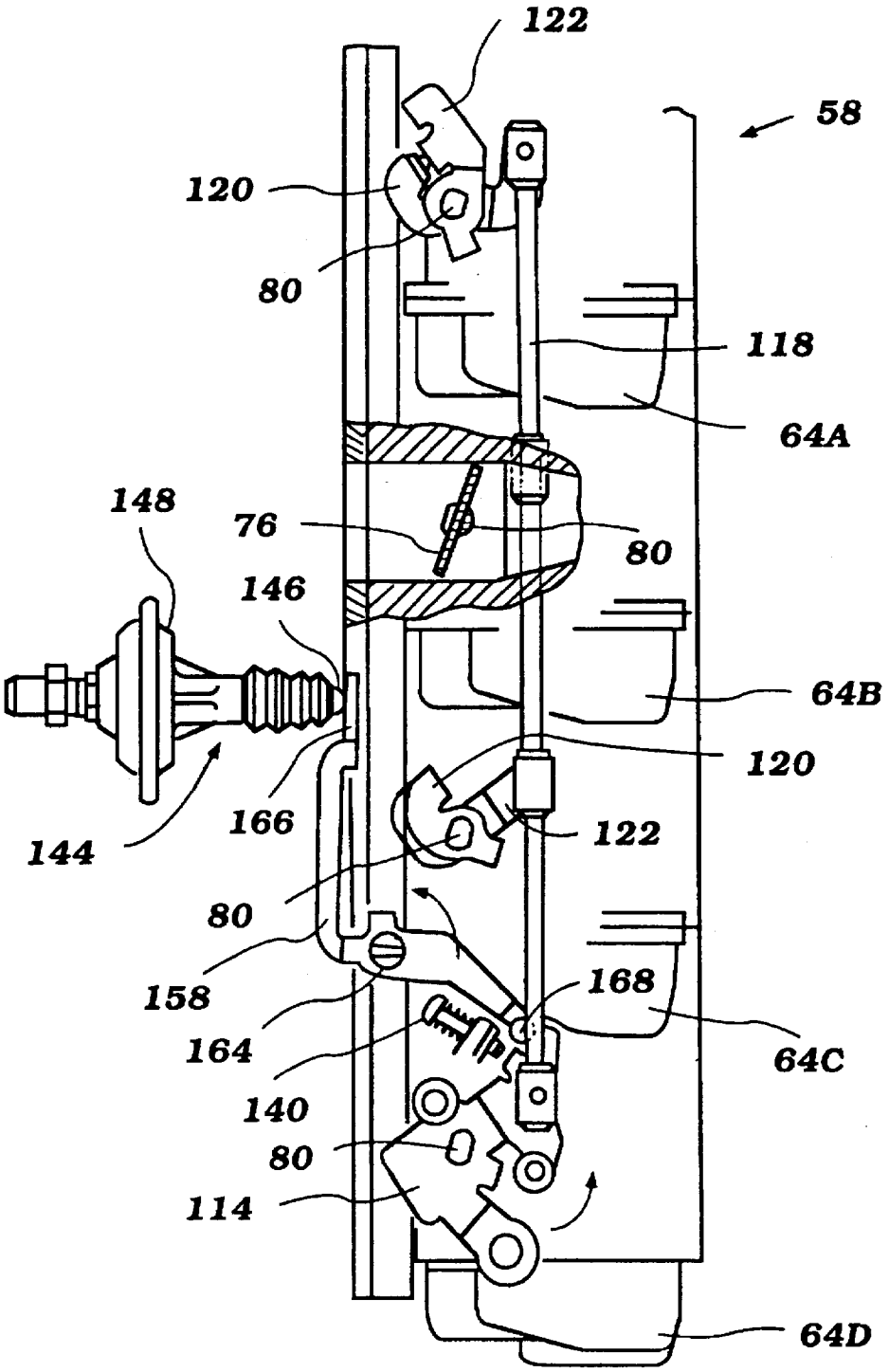
FIG. 7 is a partial sectional, side elevational view of the linkage mechanism with the throttle valves positioned in a partially closed position.
Figure 8:
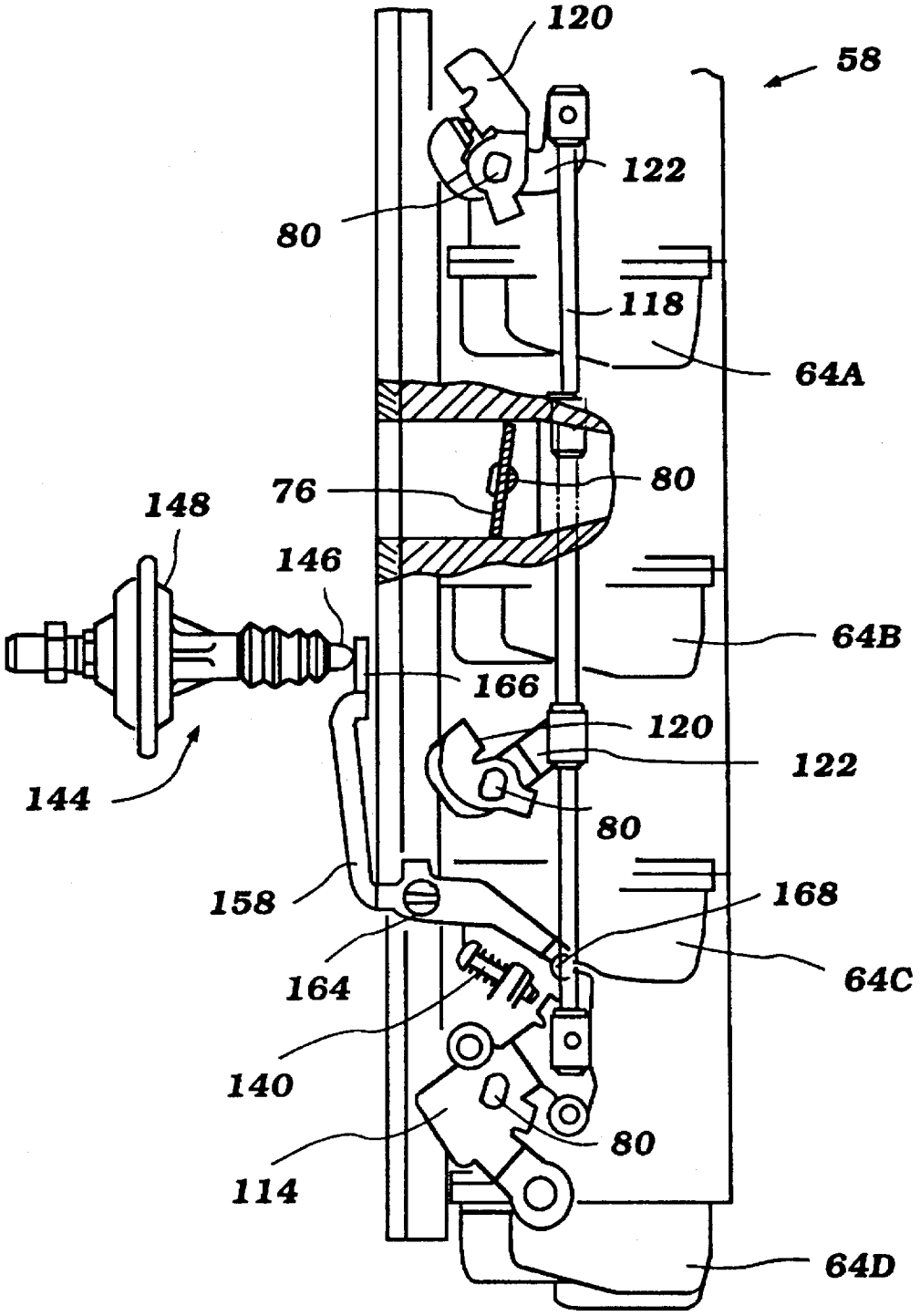
FIG. 8 is a partial sectional, side elevational view of the linkage system with the throttle valves in a generally closed position.

FIG. 7 illustrates the throttle linkage 112 at a point along its travel toward the fully closed position. At this stage, the tang 142 of the lead throttle lever 114 contacts the follower 168 of the lever 158. Further rotation of the lead throttle lever 114 rotates the lever 158 in the counter-clockwise direction to bring the abutment surface 166 of the lever 158 into contact with the plunger 146 of the throttle damper 144. The lever 158 now couples the throttle linkage 112 to the throttle damper 144. The throttle damper 144 thus controls the closure of the throttle valves 76 from this point until the fully closed position. As a result, the throttle valves 76 close slowly to inhibit the engine from stalling or drawing in a larger than desired amount of fuel.

The adjustment screw 140 contacts the abutment surface 138 on the lead throttle lever 114 to prevent additional rotation of the lead throttle lever 114. In this position, the throttle damper 144 acts against the lever 114 to bias the lead throttle lever 114 toward the open position. Likewise, the adjustment screws 124 of the upper carburetors 64 prevent further rotation of the associated throttle levers 120 once the throttle valves 76 lie in the closed position.

The present arrangement of the throttle damper 144 with the throttle linkage 112 reduces the effect play within the throttle linkage 112 has on valve synchronization. As noted above, some degree of play exists in the throttle linkage 112 due to tolerances between the clips 128 and snaps 130 which interconnect the throttle rods 118 to the throttle levers 114, 122.

FIG. 9 schematically illustrates the play between the snaps 130 and the clips 128 and the relative position of each snap 128 within the corresponding clip 128 with the throttle valves 76 in the closed position. The torsion springs apply a biasing force $F_S$ to bias the snap 130 of the throttle levers 122 for the upper three carburetors 64 against the upper sides of the corresponding clips 128. The throttle damper 144, however, applies a biasing force $F_D$ to bias the snap 130 of the lead throttle lever 114 against the lower side of the associated clip 128.

In this manner, when the throttle linkage 112 is moved to open the throttle valves 76, the snap 130 of the lead throttle lever 114 immediately acts against the throttle linkage 112. And because the snaps 130 of the upper throttle levers 122 are biased against the upper sides of linkage clips 128, the upper throttle levers 122 immediately move with the throttle linkage 112. Thus, although play inherently exists within the structure of the throttle linkage 112, the interaction of the throttle damper 144 with the throttle linkage 112 eliminates the affect of this play when the throttle valves 76 are opened and closed.

The engine 12 desirably includes an engine control unit (ECU) which controls an ignition circuit (not shown). The ignition circuit operates the spark plugs of engine 12 according to the spark timing established by the ECU (i.e., the timing at which the ignition circuit fires the spark plug relative to the position of an associated piston).

At least one of the throttle shafts 80 cooperates with a throttle valve sensor (not shown) which detects the rotational position of the throttle shaft 80. The sensor generates a signal which is indicative of the throttle shaft position. The ECU receives this signal from the sensor.

The ECU uses this information to determine when the throttle damper 144 retards or slows the closure of the valves 76. During this period, the ECU instructs the ignition circuit to fire the spark plugs earlier in the combustion cycle, i.e., the ECU instructs the ignition circuit to advance the spark timing of the engine 12.

Although this invention has been described in terms of certain preferred embodiments, other embodiments apparent to those of ordinary skill in the art are also within the scope of this invention. Accordingly, the scope of the invention is intended to be defined only by the claims that follow.

What is claimed is:

1. An induction system for a marine engine comprising a plurality of throttle devices which communicate with a plurality of runners of an engine intake manifold, a throttle linkage which interconnects said throttle devices so as to synchronize the operation of said throttle devices which move at least over a range of travel between two operational positions, and a throttle damper positioned between two of said runners, said throttle damper being selectively coupled to said throttle linkage such that said throttle damper controls the movement of the throttle devices at least over a portion of said range of travel.

2. An induction system as in claim 1, wherein a coupling between said throttle damper and said throttle linkage selectively couples said throttle damper to said throttle linkage depending upon the a direction of travel between said operational positions.

3. An induction system as in claim 2, wherein one of said operational positions is a closed position and the other of said operational positions is a wide-open position.

4. An induction system as in claim 3, wherein said coupling couples said throttle damper to said throttle linkage during at least a portion of the travel when closing the throttle devices.

5. An induction system as in claim 4, wherein said coupling couples said throttle damper to said throttle linkage when said throttle devices near the closed position.

6. An induction system as in claim 5, wherein a bracket supports said throttle damper between said runners, said throttle damper being attached to said bracket in a manner permitting the position of the throttle damper relative to the throttle linkage to be adjusted to alter the point along the travel at which the coupling couples said throttle damper to said throttle linkage.

7. An induction system as in claim 4, wherein said coupling decouples said throttle damper from said throttle linkage when opening said throttle devices.

8. An induction system as in claim 2, wherein said coupling comprises a lever which operates between said throttle linkage and said throttle damper.

9. An induction system as in claim 8, wherein said lever includes an abutment surface which acts against a plunger of said throttle damper.

10. An induction system as in claim 9, wherein said abutment surface lies generally perpendicular to an axis along which said plunger operates.

11. An induction system as in claim 8, wherein said lever generally has an L-shape formed by two arms and is rotatably fixed at an intersection between said two arms, an end of one of said arms selectively acts against said throttle damper and an end of said other arm selectively contacts said throttle linkage.

12. An induction system as in claim 8, wherein said lever selectively operates with said throttle linkage so as to move with said throttle linkage over said portion of said travel.

13. An induction system as in claim 12, wherein said throttle devices each comprise a throttle valve operated by a throttle shaft, and said throttle linkage includes a plurality of throttle levers, each throttle lever being connected to one of said throttle shafts, and said lever operating between said throttle damper and said throttle linkage is connected to one of said throttle levers.

14. An induction system as in claim 13, wherein said throttle shafts lie parallel to one another, and are positioned one above the other generally within a common vertical plane.

15. An engine including an induction system comprising a plurality of throttle devices which communicate with the engine, said throttle devices moving between a closed position and an wide-open position, a throttle linkage interconnecting said throttle devices so as to synchronize the operation of said throttle devices, a throttle damper selectively coupled to said throttle linkage such that said throttle damper controls the movement of the throttle devices as the throttle devices near the closed position when closing the throttle devices, and an igniting timing control system which advances igniting timing of the engine during a period in which said throttle damper controls the movement of the throttle devices.

16. The engine as in claim 15, wherein said engine includes an intake manifold including a plurality of runners which communicate with said throttle devices, and said throttle damper is positioned between two of said runners.

17. An engine as in claim 15, wherein a lever selectively couples said throttle damper to said throttle linkage.

18. An engine as in claim 17, wherein said lever includes an abutment surface which acts against a plunger of said throttle damper, said abutment surface lying generally perpendicular to an axis along which said plunger operates.

19. An induction system as in claim 18, wherein said throttle devices each comprise a throttle valve operated by a throttle shaft, and said throttle linkage includes a plurality of throttle levers, each throttle lever being connected to one of said throttle shafts, and said lever operating between said throttle damper and said throttle linkage is arranged to selectively cooperate with one of said throttle levers.

20. An induction system as in claim 19, wherein said throttle levers are arranged one above the other in a vertical direction.

21. An induction system for a marine engine comprising a plurality of throttle devices which communicate with a plurality of runners of an engine intake manifold, a throttle linkage which interconnects said throttle devices so as to synchronize the operation of said throttle devices which move at least through a range of travel between two operational positions, and a throttle damper being selectively coupled to said throttle linkage such that said throttle damper controls the movement of the throttle devices at least over a portion of said range of travel.

22. An induction system as in claim 21, wherein a coupling between said throttle damper and said throttle linkage selectively couples said throttle damper to said throttle linkage depending upon the a direction of travel between said operational positions.

23. An induction system as in claim 22, wherein one of said operational positions is a closed position and the other of said operational positions is a wide-open position.

24. An induction system as in claim 23, wherein said coupling couples said throttle damper to said throttle linkage during at least a portion of the travel when closing the throttle devices.

25. An induction system as in claim 24, wherein said coupling couples said throttle damper to said throttle linkage when said throttle devices near the closed position.

26. An induction system as in claim 24, wherein said coupling decouples said throttle damper from said throttle linkage when opening said throttle devices.

27. An induction system as in claim 22, wherein said coupling comprises a lever which operates between said throttle linkage and said throttle damper.

28. An induction system as in claim 27, wherein said lever selectively operates with said throttle linkage so as to move with said throttle linkage over said portion of said travel.

* * * * *